United States Patent [19]

Darling et al.

[11] Patent Number: 4,610,697

[45] Date of Patent: Sep. 9, 1986

[54] COAL GASIFICATION SYSTEM WITH PRODUCT GAS RECYCLE TO PRESSURE CONTAINMENT CHAMBER

[75] Inventors: Scott L. Darling; Michael C. Tanca, both of Tariffville; Paul R. Thibeault, Windsor, all of Conn.

[73] Assignee: Combustion Engineering, Inc., Windsor, Conn.

[21] Appl. No.: 683,460

[22] Filed: Dec. 19, 1984

[51] Int. Cl.[4] ..... C10J 3/68

[52] U.S. Cl. ..... 48/77; 48/67; 48/69; 48/DIG. 2; 165/108; 165/134.1; 422/203; 422/204

[58] Field of Search ..... 48/67, 77, 69, 87, DIG. 2; 422/202, 203, 204; 165/108, 134; 122/7 R; 55/355

[56] References Cited

U.S. PATENT DOCUMENTS

| | | | |
|---|---|---|---|
| 4,103,902 | 8/1978 | Steiner et al. | 277/12 |
| 4,343,626 | 8/1982 | Peise et al. | 48/67 |
| 4,455,154 | 6/1984 | Blasiole | 48/77 |

FOREIGN PATENT DOCUMENTS 912385 5/1954 Fed. Rep. of Germany .

*Primary Examiner*—Donald Czaja
*Assistant Examiner*—Jennifer E. Cabaniss

[57] ABSTRACT

A pressurized coal gasification system having double wall containment vessels (2,10) is disclosed. The gasification vessel (2) is provided with a gas tight water seal (36) for connecting the lower end of the inner water-cooled vessel (4) with the bottom supported slag tank (32). The seal (36) prevents gas leakage between the vessel interior and the pressurized annular volume (24) formed between the inner and outer gasification chambers (4,6). A flow of clean, particulate-free product gas (60) is routed into the contiguous annular volume (24,26,28) formed between the inner water-cooled gas directing members (4,20,12) and the outer, pressure containing members (6,22,16) to prevent either leakage of raw product gas into the annular volume or dilution of the product gas (46) by leakage of the sealing gas (60) into the hot product gas flowstream.

4 Claims, 3 Drawing Figures

COAL GASIFICATION SYSTEM WITH PRODUCT GAS RECYCLE TO PRESSURE CONTAINMENT CHAMBER

FIELD OF THE INVENTION

The present invention relates to a pressurized coal gasification system, and more particularly to a pressurized coal gasification system wherein water-cooled gas directing members are disposed within pressure containing members.

BACKGROUND OF THE INVENTION

The production of clean fuel gas from coal or other carbonaceous solid feedstock promises to be an economical source of energy and/or chemical feedstock for the electric generating and chemical process industries. In a typical coal gasification system, crushed or pulverized coal is admitted into a vessel along with a metered amount of oxygen or air. Partial combustion of the coal with the oxidant results in the production of a fuel gas containing combustible constituents such as carbon monoxide, methane, and hydrogen. The fuel gas as initially produced also may contain such undesirable compounds as hydrogen sulfide, inert flyash, and unreacted carbon. It is typical in such systems to remove the sulfur and ash compounds from the fuel gas stream for eventual disposal, and for economic reasons to separate and utilize the unreacted carbon, possibly by recycle to the gasifier vessel.

Pressurized coal gasification systems operate at absolute pressures of three atmospheres or higher, typically being used to supply a fuel gas to a generating gas turbine. The gasification reaction, product gas cooling, gas cleanup, and other functions of the system must all be performed under pressure, entailing a considerable increase in cost and complexity over an atmospheric system. This additional cost and complexity is offset by the higher product gas energy content and reduced equipment size resulting from the use of a pressurized process.

Typical pressurized gasification systems use a double wall vessel for the gasification and initial heat exchange steps. In a typical double wall vessel, an inner, water-cooled chamber contains and directs the reactions and product gas flow while an outer, pressure resistant chamber provides the physical strength necessary to contain the process. In this system, the inner vessel is designed to protect the outer vessel from the heat of the gasification reaction and product gas, but is unable itself to withstand a significant pressure differential across its walls. Typical chambers of this type are constructed of a plurality of longitudinally welded water carrying tubes, such as those used in modern utility steam generators.

The outer vessel, designed to contain the pressures of the gasification process, is typically a solid vessel which, without the protection of the water-cooled inner chamber, is unable to withstand the high heat flux generated by the exothermic coal-oxidant reactions. For elongated inner and outer chambers, an annular space between the water-cooled and pressure-restraining members permits access for repair and maintenance of the respective components.

Due to thermal transients experienced during operation, a differential vertical thermal expansion of 20 centimeters (8 inches) or more may occur between the inner and outer chambers of a double wall containment vessel. For systems requiring multiple feed and extraction points for feedstock, waste materials, and product gas, it is therefore necessary to accommodate the differential vertical thermal displacement at various points along the length of the double wall vessel in order to permit entry and exit of the reactants and products of the gasification reaction. Such solutions are also known in the prior art and may include sliding seals, flexible connectors and other means.

What each of these prior art methods has in common is the lack of a totally secure sealing method around the point of penetration into the inner, water-cooled chamber. Moreover, typical construction methods for fabricating inner vessels of longitudinally welded tubing often result in an inner chamber wherein material may leak between the interior of the water-cooled chamber and the surrounding annular volume, and vice versa. Such leakage is undesirable as the untreated product gas is dirty and corrosive and may adversely affect equipment within the annular volume. Alternatively, if inert nitrogen is supplied into the annular volume to create a slight differential pressure across the water-cooled chamber wall, any leakage of this seal gas into the product gas flow stream will result in a dilution of the gas stream and a degradation of the final product gas heating value.

SUMMARY OF THE INVENTION

The present invention provides a pressurized coal gasifier for producing a clean, particulate free fuel gas suitable for use in a gas turbine-generator or as a feedstock for a methanation or other chemical process. The gasification system includes a pressure containment chamber surrounding an inner, water-cooled chamber wherein a gasification reaction takes place, a second pressure containment chamber surrounding a process gas heat exchanger for cooling the gas produced by the gasification reaction, and a conduit between the first and second vessels having an outer pressure containing wall and an inner water-cooled transfer duct for conducting the produced gas from the gasifier vessel to the heat exchanger.

The gasifier vessel includes a slag tap disposed at the bottom for removal of any molten slag produced by the gasification reaction. Differential thermal expansion between the pressure containment chamber and the water-cooled gasifier chamber is accommodated without loss of inter-chamber sealing by a water seal between the chambers which permits the liquid slag to be removed from the chambers without the occurrence of gas leakage into the annular volume.

Further, the water seal permits the use of a relatively weak waterwall type construction by providing a means to limit differential presure excursions across the walls of the water-cooled chamber.

The present invention further provides a positive flow of clean fuel gas into and through the annular volume formed between the respective inner water-cooled members and the outer pressure resistant members of the gasifier, transfer conduit and heat exchanger assemblies. The presence of clean gas in this annular volume prevents infiltration of undesirable solids and dirty fuel gas, reducing the chances of possible equipment damage or failure.

BRIEF DESCRIPTION OF THE DRAWING FIGURES

DESCRIPTION OF THE PREFERRED EMBODIMENT

Figure 1:
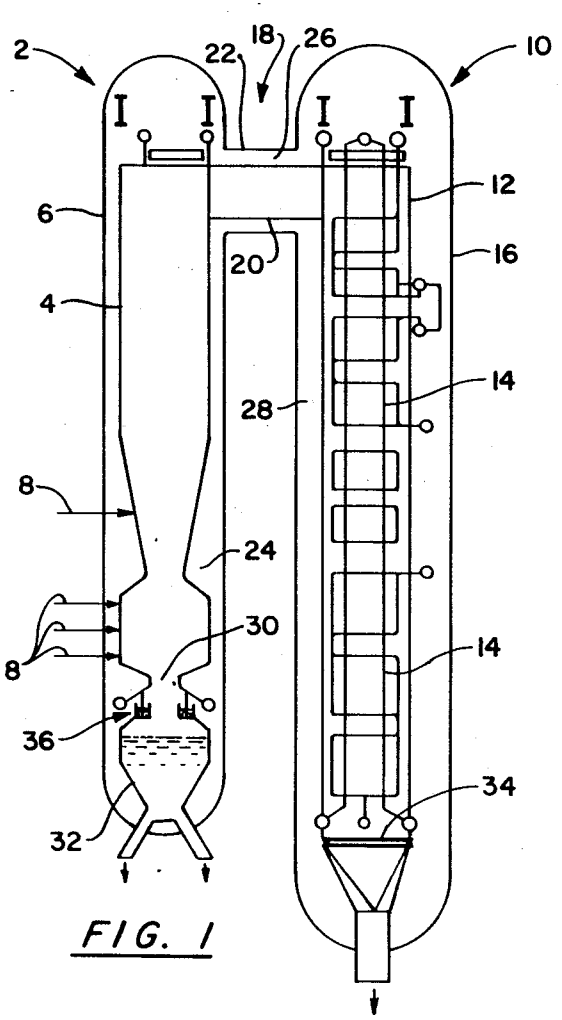
FIG. 1 shows a cross-sectional view of joined gasification and heat exchange vessels for a pressurized gasification process.

Referring now to FIG. 1, a schematic cross-sectional view of a gasifier-heat exchanger installation according to the present invention is shown. The gasifier vessel 2 is shown as a vertically oriented, elongated vessel having an inner, water-cooled chamber 4 for containing the high temperature fuel gas producing reaction. An outer, pressure resistant chamber 6 surrounds the inner chamber 4 and forms a pressure resistant envelope for containing the high pressure reaction. Coal and oxidant feed points, indicated generally by reference numeral 8 indicate the various locations at which feedstock and reactant gas are fed into the inner water-cooled chamber 4.

The gasifier vessel 2 is shown in tandem with the heat exchange vessel 10, which includes an inner, water-cooled chamber 12 containing a plurality of heat exchangers 14 for cooling product gas flowing therethrough. The inner chamber 12 is surrounded by a pressure resistant chamber 16 which prevents leakage of the pressurized gases contained therein.

The gasifier vessel 2 and the heat exchange vessel 10 are connected by a horizontally oriented cross-over conduit 18 disposed between the vessels and having an inner, water-cooled duct 20 for directing the hot product fuel gas from the inner gasification chamber to the inner heat exchanger chamber. Also included in the transfer conduit is an outer, pressure resistant duct 22 which is sealingly engaged with the respective pressure resistant members 6, 16 of the vessels 2, 10.

The structure as described hereinabove forms a series of contiguous annular volumes 24, 26, 28 between the respective inner and outer members 4, 6; 20, 22; 12, 16 of the vessels and conduit 2, 18, 10.

The embodiment of the present invention shown in FIG. 1 is a gasifier of the slagging type, wherein the gasification reaction occurs at an elevated temperature sufficient to liquify any inert ash compounds present in the feed coal. This liquified inert ash, or slag, collects on the walls of the inner chamber 4 and runs downward under the influence of gravity, eventually exiting the inner chamber 4 through a slag tap opening 30 located at the bottom thereof. The discharged slag enters a slag tank 32 prior to eventual evacuation from the pressure resistant chamber 6.

It will be appreciated by those skilled in the art of large scale steam generation and heat transfer that the double wall vessels 2, 10 as described hereinabove will experience significant differential thermal expansion during periods of startup, shutdown and other changes in operating conditions. In order to accommodate such thermal expansion without requiring large scale flexible connectors to be used at the junction of the cross-over conduit 18 and the individual vessels 2, 10, the inner and outer chambers of each vessel 4, 6 and 12, 16 are supported at the uppermost portions and depend vertically downward therefrom.

This support arrangement, while simplifying the construction and support of the transfer conduit 18 and the water-cooled duct 20, results in considerable differential vertical displacement between the inner and outer members at the lower portions thereof. The bottom of each vessel 2, 10 is the point of discharge of the quenched slag and cooled product gas, respectively. For the heat exchange vessel 10 which discharges cooled product gas at the lower portion thereof, a simple corrugated expansion joint 34 is sufficient to provide expansion sealing between the interior of the inner heat exchange chamber and the heat exchange vessel annulus 28, due to the relatively cool temperature of the product gas at this point.

For the gasifier vessel 2 a more sophisticated sealing arrangement is required in order to prevent leakage between the gasifier vessel annular volume 24 and the interior of the inner gasifier chamber 4. A water seal 36 of the type as described hereinbelow is therefore provided to insure adequate sealing between the inner vessel interior and the annular volume 24 while still allowing differential thermal displacement between the inner and outer gasifier vessels 4, 6 to occur.

Figure 3:
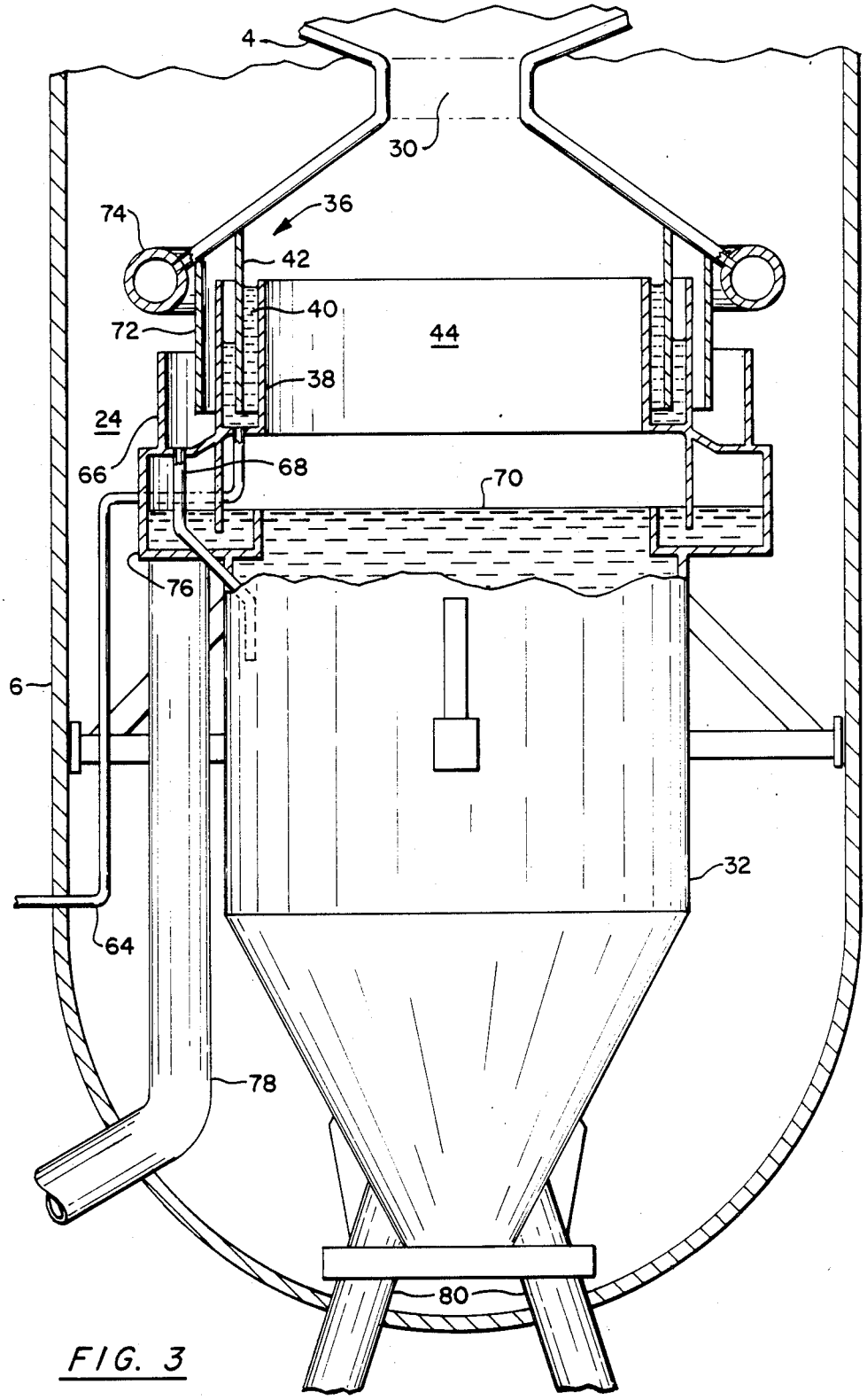
FIG. 3 shows a detailed view of the water seal disposed at the lower part of the inner water-cooled chamber.

Referring now to FIG. 3 a more detailed discussion of the water seal 36 will now be provided. FIG. 3 shows the lower portion of the inner chamber 4 and the slag tap opening 30 as well as the slag tank 32. An annular channel 38 is disposed about the upper portion of the slag tank 32, the channel 38 being filled with water or other liquid 40. Extending vertically downward from the inner chamber 4 is a dam 42 which is sealingly engaged with the lower portion of the inner chamber 4 and which extends beneath the surface of the water fill 40 in the channel 38.

As will be appreciated by a careful examination of FIG. 3, the inner vessel 4 is therefore free to be displaced with respect to the slag tank 32 without the occurrence of any gas leakage between the slag flow path 30, 44 and the gasifier vessel annular volume 24, at least for so long as the vertical dam 42 remains beneath the surface of the water 40. The slag tank 32 is secured to the outer chamber wall 6 and vertically movable therewith.

One additional feature of the water seal 36 is that the seal 36 may also function as a safety valve to prevent the occurrence of an unusually large or unacceptable pressure differential between the interior of the inner chamber 4 and the annular volume 24 of the gasifier vessel 2. Should an unusually large pressure differential occur across the water seal 36, the seal will simply "blow out" allowing gas from the higher pressure region to pass through the channel and around the vertical dam until the respective pressures become more nearly equivalent and removing the danger of damage to the relatively flimsy inner chamber 4. This safety feature is operable to relieve excessive pressure either internal or external to the inner chamber 4. The seal 36 thus permits the inner chamber 4 to be designed with less pressure resistance than would otherwise be required in these circumstances.

FIG. 3 also shows in detail a means for maintaining the presence of the water seal 36 both before and after the occurrence of a differential pressure excursion sufficient to blow out the liquid 40 of the seal 36. During operation, fresh water flows continuously into the channel 38 via inlet line 64. Excess water from the channel 38 spills either into an annular overflow box 66, eventually entering the water-filled slag tank 32 via seal drain line 68 or directly into the slag tank 32. It should be noted that the seal drain line 68 extends beneath the slag tank water surface 70 to a depth approximately equal to the vertical height of the seal channel 38 and that the seal drain line entrance is a similar height above the slag tank water surface 70. This configuration prevents undesirable siphoning or leakage of water between the slag tank interior and the annular volume 24, even under conditions of extreme pressure differential up to and including that required to blow out the water seal 36.

A seal blow out caused by a relative overpressure of the inner chamber 4 could result in splashing of the relatively cool seal liquid 40 onto the adjacent hot waterwall inlet heater 74 and the outer chamber wall 6. To prevent this splashing and the possible undesirable thermal shock to the adjacent hot structure, the preferred embodiment of the present invention employs a splash guard shown as an annular skirt 72 surrounding the channel 38 and extending downward from the inner chamber waterwall. The water splashed from the channel 38 is replaced by fresh seal water from inlet line 64 upon subsidence of the upset condition.

Excess water from the slag tank enters the slag tank overflow box 76 and is drained therefrom via the slag tank overflow line 78. Solid slag, having been cooled from the liquid state by contact with the water present in the slag tank 32 sinks to the bottom of the tank 32 and is eventually removed through transport conduits 80 or other means well known in the art.

Figure 2:
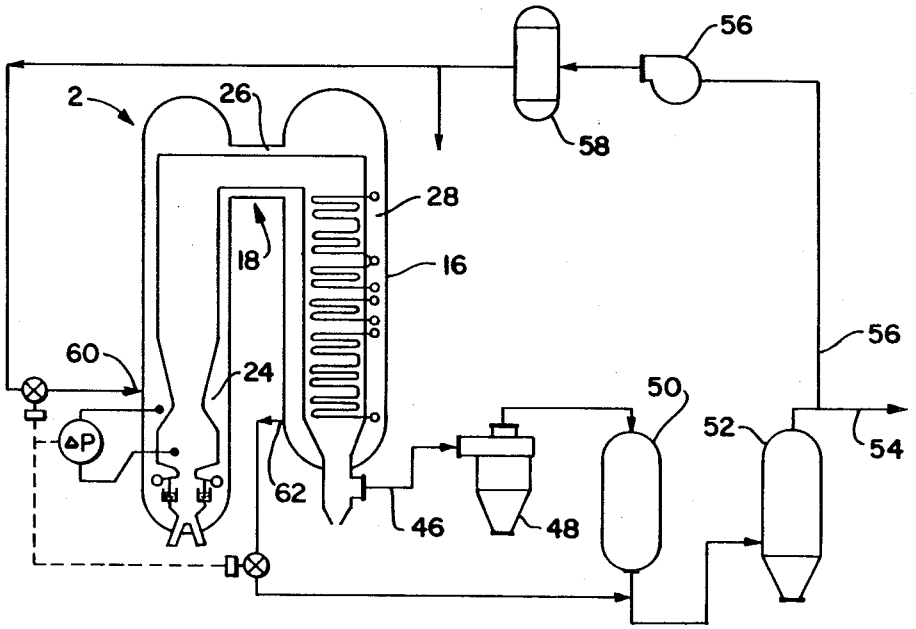
FIG. 2 shows a schematic of the gas flow of the gasification process according to the present invention.

Referring now to FIG. 2, the method of supplying a flow of seal gas to the contiguous annular volumes 24, 26, 28 will now be described. As can be seen in the drawing figure, cooled product fuel gas 46 exiting the heat exchange vessel 10 passes through a preliminary solids removal separator 48 before entering a sulfur removal system 50. The desulfurized product fuel gas next enters a final dust removal means 52 before being routed 54 to the end user.

A portion 56 of the clean, particulate and sulfur-free product fuel gas is returned to the gasification vessel 2, first passing through a product gas compressor 56 and pressure accumulator 58. This pressurized clean fuel gas is admitted 60 into the annular volume 24 of the gasifier vessel 2 and flows through each of the contiguous volumes 24, 26, 28 of the gasifier vessel 2, cross-over conduit 18, and heat exchange vessel 10 before being vented 62 therefrom as shown in FIG. 2. The vented seal gas 62 is returned to the primary product gas stream as shown in the figure.

The presence of a flow of clean product fuel gas at a pressure slightly above that of the interior of the inner water-cooled vessels 4, 20, 12 discourages any transfer of material from the inner gasification and heat exchange chambers into the respective annular volumes. Furthermore should any leakage occur in the opposite direction, the presence of clean fuel gas in the raw product gas reaction or flowstream does not act to dilute or otherwise degrade the product gas heating value.

The method and apparatus of the present invention for providing a seal between the interior of the inner water-cooled members of a pressurized coal gasification process and the annular volume formed between the inner and outer members of said system results in a safe, effective method for preventing the undesirable leakage of material into said annular volume and for accommodating the vertical differential expansion between the lower end of the inner and outer chambers of a slagging, pressurized gasification process.

These and other advantages will be apparent to one skilled in the art upon review of the foregoing specification and the appended claims and drawing figures.

We claim:

1. A pressurized coal gasification system, comprising:

a vertically oriented, elongated gasifier vessel having an inner, water-cooled chamber for containing a high temperature fuel gas producing reaction, and an outer, pressure resistant chamber;

a vertically oriented, elongated heat exchange vessel having an inner, water-cooled chamber containing means for cooling the fuel gas produced in the gasification vessel and an outer, pressure resistant chamber;

a horizontally oriented cross-over conduit disposed between the gasifier vessel and the heat exchange vessel, the cross-over conduit having an inner, water-cooled transfer duct for conveying the hot product fuel gas from the inner gasification vessel to the inner heat exchange vessel, and an outer, pressure resistant duct sealingly engaged at opposite ends to the pressure resistant gasification chamber and the pressure resistant heat exchange chamber;

the gasification vessel, the cross-over conduit, and the heat exchange vessel each having an annular volume therein formed between the respective pressure resistant members and water-cooled members, the respective annular volumes forming a single, contiguous annular gas flow volume, said annular gas flow volume being distinct from the hot product gas flow within the respective water-cooled members;

means for removing entrained particulate matter from the cooled product fuel gas emerging from the heat exchange means;

means for controllably introducing at least a portion of the particulate free product fuel gas from the removal means into the said annular gas flow volume for flow therethrough; and means for returning said portion of product gas to the cooled product fuel gas at a location downstream of said gasifier vessel with respect to said product fuel gas flow, from said annular gas flow volume.

2. The pressurized coal gasification system as recited in claim 1, wherein the gasification vessel further comprises:

means for removing liquified coal ash from the inner, water-cooled chamber, said removing means including, a vertical slag flow passage extending downward from the bottom of the inner gasification chamber and passing through the outer, pressure resistant chamber, the slag passage further including a normally gas tight expansion joint for accommodating any vertical differential expansion between the inner and outer chambers.

3. The pressurized coal gasification system as recited in claim 2 wherein the normally gas tight expansion joint further includes:

an annular water-filled channel secured to the pressure resistant chamber and disposed about the slag flow passage; and an annular dam, secured to the water-cooled chamber and extending downward beneath the water-surface in the annular channel.

4. The pressurized coal gasification system as recited in claim 3 wherein the normally gas tight expansion joint further includes:

a splash skirt, secured to the water-cooled gasification chamber and surrounding the annular channel, for preventing the splashing of channel water onto any heated surfaces adjacent to the channel during a period of excessive differential pressure across the inner water-cooled gasifier chamber wall;

means for supplying makeup water to the annular channel; and means for collecting overflow water from the annular channel.

* * * * *